US006524066B2

(12) United States Patent
Thut

(10) Patent No.: US 6,524,066 B2
(45) Date of Patent: Feb. 25, 2003

(54) IMPELLER FOR MOLTEN METAL PUMP WITH REDUCED CLOGGING

(76) Inventor: Bruno H. Thut, 16755 Park Cir., Chagrin Falls, OH (US) 44023

( * ) Notice: Subject to any disclaimer, the term of this patent is extended or adjusted under 35 U.S.C. 154(b) by 0 days.

(21) Appl. No.: 09/774,938

(22) Filed: Jan. 31, 2001

(65) Prior Publication Data

US 2002/0102159 A1 Aug. 1, 2002

(51) Int. Cl.[7] ..... F04D 7/06
(52) U.S. Cl. ..... 415/200; 415/206; 416/181
(58) Field of Search ..... 415/200, 206, 415/217.1, 90, 110, 170.1, 173.1, 197; 416/181, 182, 179, 185, 241 B, 223 B

(56) References Cited

U.S. PATENT DOCUMENTS

| | | | | |
|---|---|---|---|---|
| 1,865,918 A | | 7/1932 | Junkers | |
| 2,808,782 A | | 10/1957 | Thompson et al. | |
| 3,291,473 A | | 12/1966 | Sweeney et al. | 415/200 |
| 3,836,280 A | * | 9/1974 | Koch | 415/200 |
| 3,984,234 A | | 10/1976 | Claxton et al. | 415/200 |
| 4,351,514 A | * | 9/1982 | Koch | 261/29 |
| 4,456,424 A | | 6/1984 | Araoka | |
| 4,491,474 A | | 1/1985 | Ormesher | |
| 4,504,392 A | | 3/1985 | Groleke | |
| 4,518,424 A | | 5/1985 | Ormesher | |
| 4,743,428 A | | 5/1988 | McRae et al. | |
| 4,786,230 A | | 11/1988 | Thut | 415/200 |
| 5,268,020 A | | 12/1993 | Claxton | |
| 5,586,863 A | | 12/1996 | Gilbert et al. | 415/200 |
| 5,597,289 A | | 1/1997 | Thut | 415/200 |
| 5,622,481 A | | 4/1997 | Thut | 415/9 |
| 5,634,770 A | | 6/1997 | Gilbert et al. | 415/216.1 |
| 5,716,195 A | | 2/1998 | Thut | 417/53 |
| 5,785,494 A | | 7/1998 | Vild et al. | 415/200 |
| 5,842,832 A | | 12/1998 | Thut | 415/200 |
| 5,951,243 A | * | 9/1999 | Cooper | 415/200 |
| 6,019,576 A | | 2/2000 | Thut | 415/200 |
| 6,152,691 A | * | 11/2000 | Thut | 415/200 |
| 6,254,340 B1 | * | 7/2001 | Vild et al. | 415/200 |
| 6,303,074 B1 | * | 10/2001 | Cooper | 415/200 |
| 2001/0028846 A1 | | 10/2001 | Vild et al. | |

OTHER PUBLICATIONS

Three pages containing Figs. 1–4 from U.S. Patent No. 6,019,576 showing pump and impeller sold more than one year before the filing date.

* cited by examiner

*Primary Examiner*—Edward K. Look
*Assistant Examiner*—Kimya N McCoy
(74) *Attorney, Agent, or Firm*—Watts Hoffmann Fisher & Heinke

(57) ABSTRACT

One aspect of the invention is directed to an impeller made of a non-metallic, heat resistant material, comprising a generally cylindrical shaped body having a central rotational axis, first and second generally planar end faces extending transverse to the central axis and a side wall extending between the first and second faces. A plurality of passages have inlets circumferentially spaced apart from each other on the first face, outlets at the impeller sidewall, and connecting portions extending between the inlets and the outlets transverse to the central axis. Each of the passages extends at an angle to the central axis along substantially an entire length and perimeter of the passages. Another aspect of the invention is directed to an impeller made of a non-metallic, heat resistant material comprising a central hub portion extending along a rotational axis of the impeller and first and second impeller bases extending from the hub portion at opposing end portions of the impeller transverse to the central axis. The first impeller base and the second impeller base each comprise an outer end face. Vanes extend from the central hub portion between the first and second impeller bases. Cavities are formed between the first and second impeller bases and between adjacent vanes. A plurality of molten metal passages are circumferentially spaced apart from one another in the first end face and the second end face and terminate at the cavities. Pumps for pumping molten metal are designed so as to comprise the cylindrical bodied impeller or the vaned impeller.

31 Claims, 7 Drawing Sheets

IMPELLER FOR MOLTEN METAL PUMP WITH REDUCED CLOGGING

FIELD OF THE INVENTION

This invention relates to impellers and to pumps for pumping molten metal which employ the impellers.

BACKGROUND OF THE INVENTION

Pumps used for pumping molten metal typically include a motor carried by a motor mount, a shaft connected to the motor at one end, and an impeller connected to the other end of the shaft. Such pumps may also include a base with an impeller chamber, the impeller being rotatable in the impeller chamber. Support members extend between the motor mount and the base and may include a shaft sleeve surrounding the shaft, support posts, and a tubular riser. An optional volute member may be employed in the impeller chamber. Pumps are designed with shaft bearings, impeller bearings and with bearings in the base that surround these bearings to avoid damage of the shaft and impeller due to contact with the shaft sleeve or base. The shaft, impeller, and support members for such pumps are immersed in molten metals such as aluminum, magnesium, copper, iron and alloys thereof. The pump components that contact the molten metal are composed of a refractory material, for example, graphite or silicon carbide.

Pumps commonly used to pump molten metal may be a transfer pump having a top discharge or a circulation pump having a bottom discharge, as disclosed in the publication "H.T.S. Pump Equation for the Eighties" by High Temperature Systems, Inc., which is incorporated herein by reference in its entirety.

One problem that such pumps encounter is that they may be damaged by solid impurities contained in the molten metal including chunks of refractory brick and metal oxides (e.g. aluminum oxides). If a piece of hard refractory material becomes jammed in the impeller chamber it may destroy the impeller or shaft, and result in the expense of replacing these components. Chunks of refractory material such as brick with a higher specific gravity than the metal are disposed at the bottom of the vessel. Aluminum oxides with a lower specific gravity than the molten metal rise to the surface of the bath. Refractory material that has a specific gravity approximating that of the molten metal may be suspended in the bath. Refractory impurities in the molten metal are also a problem since, if not removed, they result in poor castings of the metal and potentially defective parts. Removing impurities from the molten metal bath is a hazardous process. A long steel paddle with an end that is in the shape of a perforated spoon is used to remove the impurities. To remove impurities with the paddle, workers need to come close to the molten metal at an area where temperatures may exceed 120 degrees Celsius. Although workers wear protective gear, they may be injured by splatters of metal. At the least, workers face a difficult task in removing the impurities, which they carry out in a two-step process, spooning the material upward from the bottom of the vessel and skimming the material from the surface. Each step typically lasts about 10–15 minutes. Removing the material from the bottom is carried out at least once a day and skimming is carried out at least once every eight hours. Removing impurities from the molten metal is a hazardous, costly, but necessary, process using traditional pump and impeller designs.

A second main design concern with a molten metal pump is clogging. Any impeller with an internal path for molten metal travel is susceptible to clogging, caused by solid pieces becoming lodged in the impeller and between the impeller and base. As mentioned, clogging can cause damage to the impeller and generate expensive down-time and repairs. Some impeller designs attempt to solve this problem with specifically designed passages. A passage with an entrance less in diameter than the exit may help to reduce clogging, as alleged in U.S. Pat. No. 5,785,494 to Vild. Particles which are small enough to enter the entrance to the passage in theory pass easily through the exit of the passage.

A third main design concern with a molten metal pump is efficiency. The geometric design of a pump impeller primarily defines the fluid dynamic characteristics of the pump. The impellers of the U.S. Pat. No. 5,785,494 which have internal passages wherein the entrance diameter of each passage is less in diameter than the exit diameter, have a design which results in losses in pump efficiency and higher operating costs. Internal passages of such impellers are configured to permit travel along a direction of the pump axis and then in a radial direction. Despite reducing clogging, impellers of this design may suffer significant efficiency losses.

There is a need for an impeller and pump for pumping molten metal not prone to clogging which offer high efficiency operation, low maintenance cost, and safe operating conditions for personnel.

SUMMARY OF THE INVENTION

The present invention is directed to a pump for pumping molten metal with an impeller. One aspect of the invention utilizes an impeller comprising internal molten metal passages which are configured to increase the efficiency of the impeller. The travel of molten metal through the passages is at an angle to the central rotational axis of the impeller. The geometry of the passages further prevents clogging. The impeller may include optional stirrer passages which are configured and arranged to enable the impeller to cause solid matter in the molten metal to move toward an upper surface of the bath.

As defined herein, the term passage means a tunnel in which the flow of molten metal may be controlled so as to travel along a defined, relatively narrow path. Vanes are defined as discrete surfaces of an impeller, extending from near a lower portion of the impeller along its rotational axis to near an upper portion of the impeller, which do work to move molten metal when the impeller is rotated. Cavities are defined herein as the regions between adjacent vanes and have a height which is much greater than the largest cross-sectional area of the impeller passages.

In general, the present invention is directed to pumps for pumping molten metal including a motor and a shaft having one end connected to the motor. An impeller is connected to the other end of the shaft which extends along a longitudinal axis, the impeller being constructed in accordance with the present invention. A base has a chamber in which the impeller is rotatable.

One embodiment of the present invention is directed to an impeller made of a non-metallic, heat resistant material comprising a body having a generally cylindrical shape. The impeller includes a central rotational axis, and first and second generally planar end faces extending transverse to the central axis. A side wall extends between the first and second faces. A plurality of passages have inlets circumferentially spaced apart from each other on the first face, and outlets at the side wall. Connecting portions of the passages extend between the inlets and the outlets transverse to the central axis.

More specifically, each passage extends at an angle to the central axis along substantially its entire length and perimeter. More preferably, the side surface of each passage intersects the impeller sidewall at a downward angle relative to an axis extending radially from the central axis. The angles of each passage to the central axis are intended to provide the impeller with a high operating efficiency. The passages are preferably reverse pitched relative to a direction of rotation of the impeller.

The impeller may include stirrer passages in one of the faces circumferentially spaced apart from each other. The stirrer passages are configured and arranged to enable the impeller to cause solid matter in the molten metal to move toward an upper surface of the bath. Each stirrer passage extends at an angle to the central axis along substantially its entire length and perimeter. The stirrer passages in the cylindrical bodied impeller may be enlarged to have a cross-sectional area approximating that of the other passages. The stirrer passages thus function as infeed passages for the molten metal and the pump may be referred to as a top-and-bottom feed pump.

The sizes of the passages in the cylindrical body impeller may be varied. In a bottom feed pump large passages (similar to the size of the passages now shown in the top face in FIG. 2) may have inlets in the bottom face of the impeller. In such pump the upper face may have no passages, relatively small cross-sectional area stirrer passages or infeed passages having a size approximating that of the lower passages. Thus, the pump may be modified, by changing the size and location of the passages in the cylindrical body impeller, so as to be one of the following: top feed; bottom feed; top feed or bottom feed with stirrer passage inlets in the opposite end face; and top-and-bottom feed.

Another embodiment of the present invention is directed to a vaned impeller made of a non-metallic, heat resistant material. The impeller includes a generally cylindrical hub portion extending along a central rotational axis, and first and second bases spaced apart from one another along the central axis at opposing end portions of the impeller and extending transverse to the central axis. Vanes extend outwardly from the central hub portion between the first and second bases. Cavities of the impeller are each disposed between the first and second bases and between adjacent vanes. The impeller top end face (in the case of a top feed pump) includes a plurality of passages. The inlets of the passages are circumferentially spaced apart from each other in the first end face, and the passages terminate at the cavities of the impeller. The passages preferably extend from the top end face, through the first base portion and terminate at the cavities, all the while extending transverse to the central axis. The invention is also directed to a pump which employs this vaned impeller.

More specifically, each passage extends through the first impeller base at an angle to the central axis along substantially its entire length and perimeter. Further, each passage extends to the cavity at a downward angle relative to an axis extending radially from the central axis. The angle of each passage to the central axis is effective to provide the impeller with a high operating efficiency. The passages are preferably reverse pitched relative to a direction of rotation of the impeller.

A bearing member may be disposed around the impeller first end face and second end face. The first and second bases may be integrally formed with the body. Alternatively, the first and second bases may comprise a plate formed separately from the impeller and fastened to it. Each stirrer passage extends at an angle to the central axis along substantially its entire length and perimeter, and terminates in a cavity. The stirrer passages are configured and arranged to enable the impeller to cause solid matter in the molten metal to move toward an upper surface of the bath.

The vaned impeller of the invention is preferably formed so that the lower passages have a large size approximating that of the other (e.g., upper) passages. Thus, the passages in the top face and the passages in the bottom face act as infeed passages which enable molten metal to be drawn into the pump from below and above the base. This enables the pump which employs the vaned impeller to function as a top-and-bottom feed pump.

The sizes of the passages in the vaned impeller may be varied. In a bottom feed pump large passages (similar in size to the passages shown in the bottom face in FIG. 6) may have inlets in the bottom face of the impeller. In such pump the upper face may have no passages, relatively small cross-sectional area stirrer passages or infeed passages having a size approximating that of the lower passages. Thus, the pump may be modified, by changing the size and location of the passages in the vaned impeller, so as to be one of the following: top feed; bottom feed; top feed or bottom feed with stirrer passage inlets in the opposite end face; and top-and-bottom feed.

The present invention presents advantages compared to typical pumps and impellers for pumping molten metal. Pumps for pumping molten metal are prone to clogging, which occurs when solid particles enter and lodge in the impeller between the impeller and base. Pumps in the prior art have attempted to address clogging with the use of internal passages having inlet diameters smaller in size than exit diameters, as in the case of the U.S. Pat. No. 5,785,494. Solid particles which are small enough to enter the entrance to the passage in theory pass through the larger exit of the passage. Nevertheless, it is believed use of the impeller of the U.S. Pat. No. 5,785,494 results in losses in pump efficiency and higher operating costs.

In contrast, one aspect of the present invention uses internal passages that permit molten metal travel at an angle to the central rotational axis along substantially the entire length and perimeter of the passage. Rotation of these passages imparts forces to the molten metal which improve the efficiency of the pump. Further, stirrer passages of the present invention, if used, may provide forces that act upon molten metal such as below the pump base in a top feed pump. Rotation of the stirrer passages is believed to enable particles, especially those suspended particles having approximately the specific gravity of the molten metal, to rise toward the surface of the bath. Therefore, when pumping molten metal according to the present invention, an improvement of pump efficiency, without clogging, is realized.

In addition, the vaned impeller of the invention moves molten metal differently than in the U.S. Pat. No. 5,785,494 in that it employs much shorter passages which are only in the upper and lower bases and which preferably extend at an angle to the central axis along substantially their entire length and periphery. In the vaned impeller of the invention the passages terminate in the much larger cavities formed between vanes of the impeller. The impeller relies on vanes to perform most of the work on the molten metal as do conventional vaned impellers, but utilizes the infeed or stirrer passages for straining to avoid clogging. In contrast, the U.S. Pat. No. 5,785,494 states that a vaned impeller is disadvantageous in that molten metal flow is difficult to control between adjacent vanes of the impeller. The U.S. Pat. No. Des. 5,785,494 relies solely on passages or tunnels to perform work to move the molten metal and is disadvantageous in that the passages extend along the central axis and thus are believed to provide the impeller with lessened efficiency. Moreover, the impeller of the U.S. Pat. No. 5,785,494 employs a sidewall which is lacking in the inventive vaned impeller. The inventive vaned impeller enables a far greater volume of molten metal to be acted upon by its vanes than do the narrow passages of the U.S. Pat. No. 5,785,494.

Many additional features, advantages and a fuller understanding of the invention will be had from the accompanying drawings and the detailed description that follows. It should be understood that the above Summary of the Invention describes the invention in broad terms while the following Detailed Description describes the invention more narrowly and presents specific embodiments which should not be construed as necessary limitations of the broad invention as defined in the claims.

DETAILED DESCRIPTION

Figure 1:
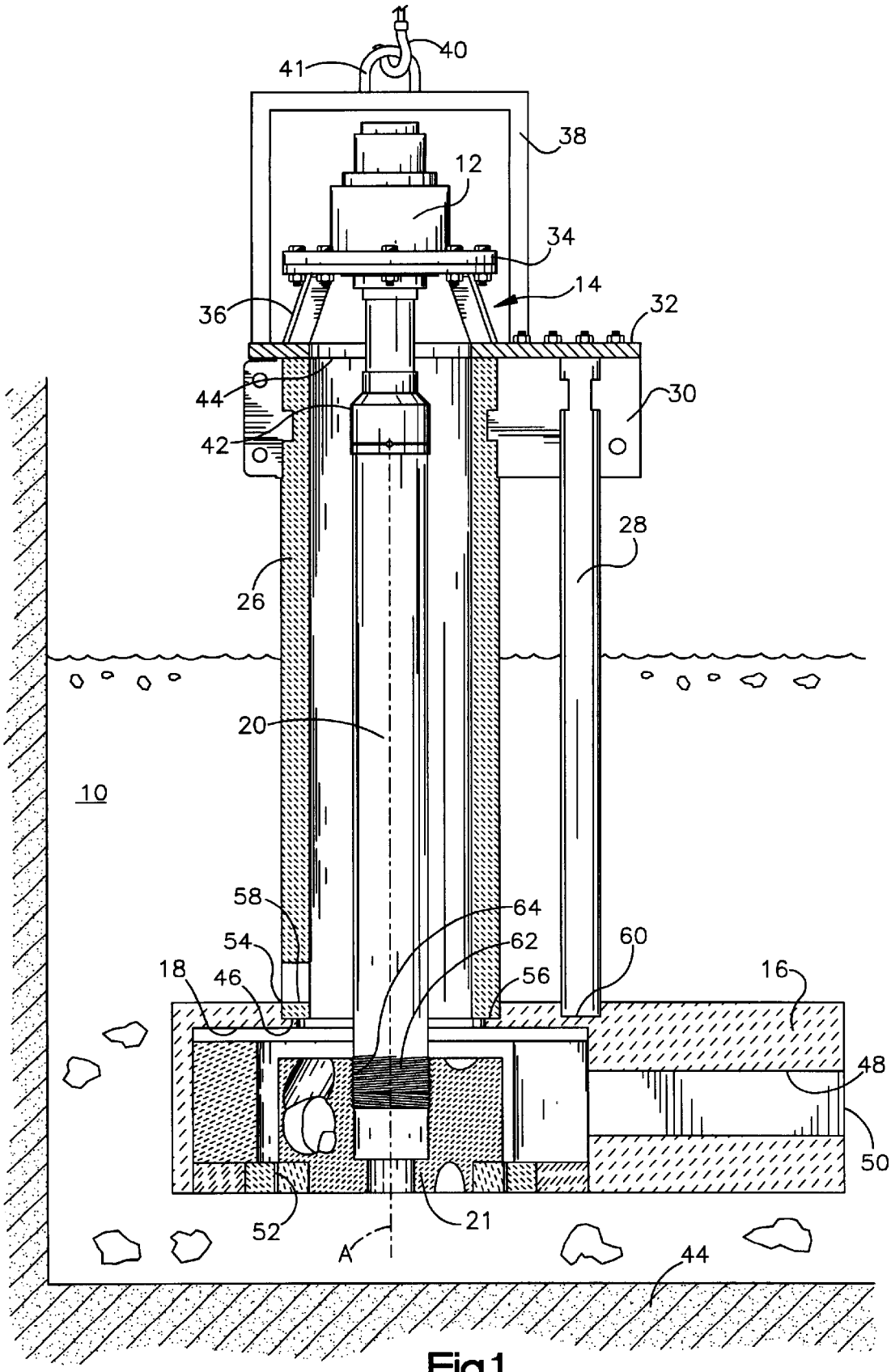
FIG. 1 is a vertical cross-sectional view of a pump constructed in accordance with the present invention.
Figure 2:
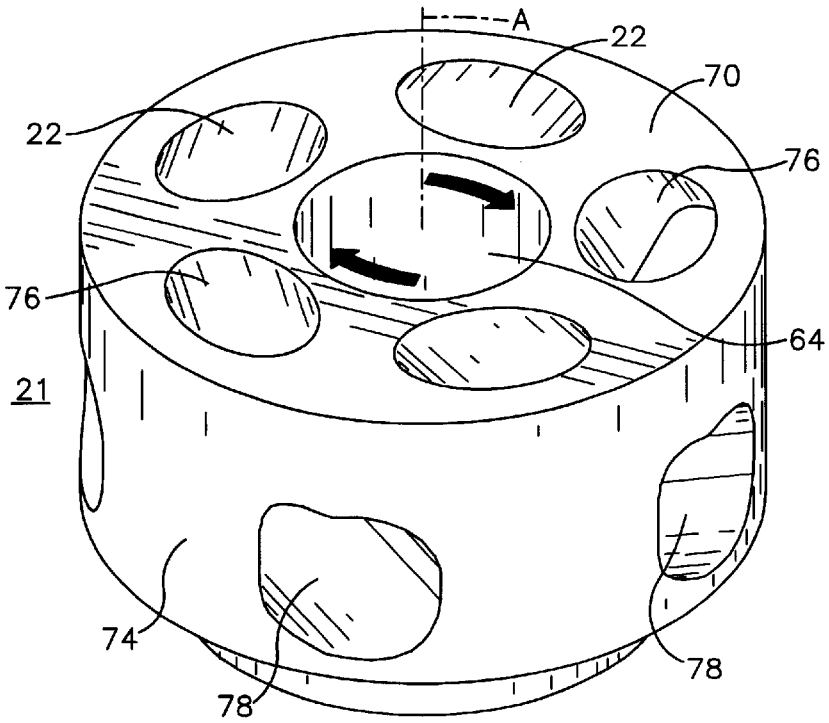
FIG. 2 is a perspective view of the impeller shown in FIG. 1.

Referring to FIGS. 1 and 2, the illustrated pump is a top feed discharge pump generally designated by reference numeral 10. The pump includes a motor 12 mounted to a motor mount 14. A base 16 has an impeller chamber 18 formed therein, the impeller chamber being defined herein as an interior chamber of the base which receives the impeller. A shaft 20 is connected to the motor 12 at one end. An impeller 21 is connected to the other end of the shaft 20 and is rotatable in the impeller chamber 18. The impeller includes a plurality of passages 22, shown in FIG. 2. These passages, in view of a unique design, provide the impeller with a high operating efficiency, while providing a straining action that prevents internal impeller clogging due to solid matter in the molten metal. The impeller also includes optional stirrer passages 24 in the base, shown in FIGS. 3–5. The stirrer passages are similar to the stirrer passages discussed in the U.S. Pat. No. 6,019,576 to Thut, which is incorporated herein by reference in its entirety. The stirrer passages are designed to enable the impeller to exert forces on the molten metal to facilitate removal of solid matter in the molten metal. The molten metal is any known in the industry, for example, aluminum or alloys thereof. The terms solid matter used herein refer to refractory material comprising refractory brick and metal oxide particles (e.g., aluminum oxide), as well as foreign objects.

A shaft sleeve 26 optionally surrounds the shaft 20. The shaft sleeve 26 and an at least one optional support post 28 are disposed between the motor mount 14 and the base 16. The shaft sleeve 26 and the support post 28 have their lower ends fixed to the base 16. A quick release clamp 30 is carried by the motor mount 14. The quick release clamp is of the type described in U.S. Pat. No. 5,716,195 to Thut, entitled "Pumps for Pumping Molten Metal," issued Feb. 10, 1998, which is incorporated herein by reference in its entirety. The clamp 30 releasably clamps upper end portions of the shaft sleeve 26 and the support post 28, for example. Individual clamps around the upper ends of each support member (e.g., posts, shaft sleeve and riser) may also be employed. The motor mount may be pivotably mounted, as disclosed in U.S. Pat. No. 5,842,832 to Thut, entitled "Pump for Pumping Molten Metal Having Cleaning and Repair Features," issued Dec. 1, 1998, which is incorporated herein by reference in its entirety.

It should be apparent that the invention is not limited to any particular pump construction, but rather may be used with any construction of transfer or circulation pump. Further, the present invention would suitably perform as a bottom feed pump. Those skilled in the art would appreciate that in a bottom feed pump, the impeller shown in FIG. 1, for example, would be inverted and the pump base constructed so as to include a recess which supports a bearing ring that is aligned with the upper bearing ring of the impeller of the bottom feed pump and that the threaded opening would be disposed at the upper end of the impeller (now shown as the lower end in FIG. 1). More than one of the inventive impellers described herein may be used, such as in a dual volute impeller pump of the type described by U.S. Pat. No. 4,786,230 to Thut.

The motor mount 14 comprises a flat mounting plate 32 including a motor support portion 34 supported by legs 36. A hanger 38 may be attached to the motor mount 14. A hook 40 on the end of a cable or the like is inserted into an eye 41 on the hanger to hoist the pump 10 into and out of the vessel or furnace. Various types of hangers are suitable for use in the present invention, for example, those 35 disclosed in the publication "H.T.S. Pump Equation for the Eighties" by High Temperature Systems, Inc. The motor 12 is an air motor or the like, and is directly mounted onto the motor support portion 34.

The shaft 20 is connected to the motor 12 by a coupling assembly 42 which is preferably constructed in the manner shown in U.S. Pat. No. 5,622,481 to Thut, issued Apr. 22, 1997, entitled "Shaft Coupling For A Molten Metal Pump", which is incorporated herein by reference in its entirety. An opening 44 in the mounting plate 32 permits connecting the motor 12 to the shaft 20 with the coupling assembly 42.

The base 16 is spaced upward from the bottom of vessel 44 by a few inches or more and has a molten metal inlet opening 46 leading to the impeller chamber 18 and a discharge passage 48 leading to an outlet opening 50. The discharge passage is preferably tangential to the impeller chamber as seen in a top view, as is known in the art (see, e.g., FIGS. 14, 17). An opening 52 is formed in a lower surface of the base and receives the impeller 21. An opening 54 surrounds the base inlet opening 46 and receives the shaft sleeve 26, openings 52 and 54 being concentric to one another relative to the axis A of the impeller. A shoulder 56 is formed in the base 16 around the inlet opening 46, and supports the shaft sleeve 26. The shaft sleeve 26 is cemented in place on the shoulder 56. The shaft sleeve 26 contains multiple inlet openings 58 adjacent the base 16 (one of which is shown). The post 28 is cemented in place in an opening 60 in the base.

Other pump base and volute configurations may be employed in the present invention such as that disclosed in U.S. Pat. No. 6,152,691, which is incorporated herein by reference in its entirety. The impeller 21 may be used in the pump shown in FIG. 13, if modified to include an upper recess and bearing ring, similar to the impeller shown in FIG. 6.

The impeller 21 is attached to one end portion of the shaft 20 such as by engagement of exterior threads 62 formed on the shaft 20 with corresponding interior threads 64 formed in the impeller 21. However, any connection between the shaft 20 and the impeller 21, such as a key way or pin arrangement, or the like, may be used.

In one embodiment shown in FIGS. 2–5, the impeller 21 has a generally cylindrically shaped body which includes a central rotational axis A, and first and second generally planar end faces 70, 72 extending transverse to the central axis. The impeller is made of a non-metallic, heat resistant material, such as graphite and/or ceramic, suitable for operating in molten metal. The first face is a top face and the second face is a bottom face in a preferred embodiment. A side wall 74 extends generally parallel to the central axis between the first and second faces and forms a perforated circumferential surface. A plurality of passages 22 have inlets 76 circumferentially spaced apart from each other on the first face 70. The preferred number of passages is five, but the number may vary as would be apparent to one skilled in the art in view of this disclosure. The impellers disclosed throughout this disclosure may be designed to vary the number and/or size of passages to achieve different flow rates with the pump (SCFM). That is, using more passages or increasing their areas results in greater flow rate with the pump. Therefore, for example, for a greater flow rate an impeller with five passages could be replaced with one having seven passages. The passages have outlets 78 at the side wall 74. Connecting portions 79 extend between the inlets 76 and the outlets 78 and form passages for molten metal travel.

Figure 4:
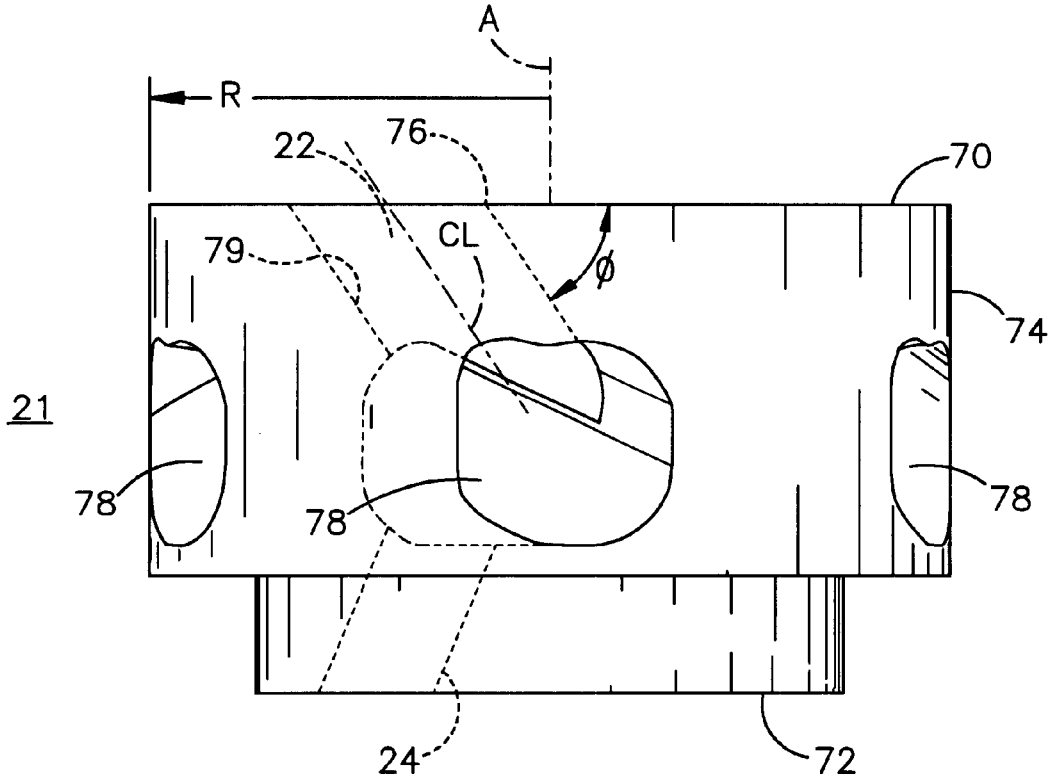
FIG. 4 is a side elevational view of the impeller shown in FIG. 2.
Figure 5:
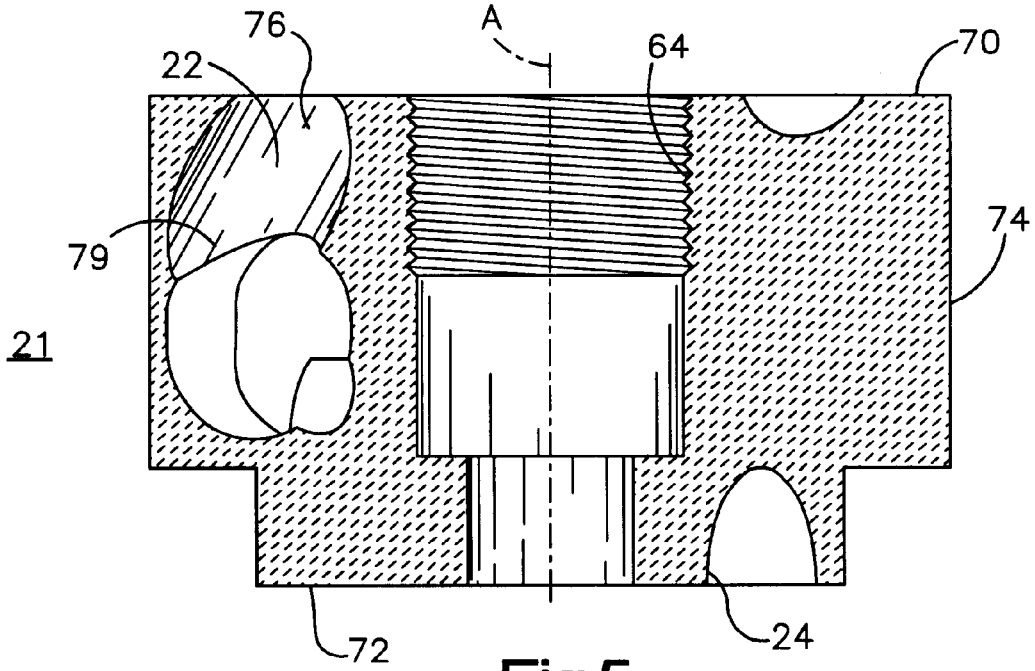
FIG. 5 is a vertical cross-sectional view of the impeller shown in FIG. 2.

The passages 22 extend transverse to and at an angle to the central axis A along substantially their entire length and perimeter, as shown in FIG. 4. No part of the passages extends parallel to the axis A. Further, the passages 22 extend to the side wall at a downward angle Ø relative to an axis R extending radially from the central axis A (or an end face). The acute angle Ø relative to an axis R as shown in FIG. 4 may range from 30° to 75° and is preferably about 45°, although the angle may vary based upon the height and diameter of the impeller, cross-sectional area of the passages and passage spacing. Those skilled in the art will be able to determine the range of angles for a particular design in view of this disclosure.

The design of the passages 22 so as to extend at an angle to the central axis A (FIG. 4) is intended to provide the impeller with a higher operating efficiency, compared to the impeller of the U.S. Pat. No. 5,785,494 which includes a passageway component extending parallel to the central axis. Further, the diameter of the inlet 76 is preferably not larger in size than the diameter of the outlet 78. These relative sizes are preferred to prevent clogging. Any piece of solid matter that enters the inlet should pass through the passage and exit the outlet. The passages 22 preferably extend along a generally straight centerline throughout their length (see FIG. 4, centerline CL). Internal impeller passages in the prior art, such as disclosed in U.S. Pat. No. 5,785,494 to Vild, have large sections of curved passageways, as well as portions extending parallel to the rotational axis. It is believed that efficiency losses result from this type of construction.

A mounting hole with the internal threads 64 is centered on the central axis of the impeller top face 70. The threads 64 engage the external threads 62 of the pump shaft 20 as shown in FIG. 1.

The impeller may include stirrer passages 24 similar to those disclosed in U.S. Pat. No. 6,019,576 to Thut. In FIG. 4, it can be seen that the stirrer passages 24 communicate with the passages 22 and lead to a common exit 78. The common exit 78 may increase the stirring forces on the bath of molten metal. The over-sized cross-sectional area of the common exit 78 relative to the inlets 76 is further advantageous to prevent clogging.

If used, the number of stirrer passages 24 in the base is preferably five. However, it will be appreciated by those skilled in the art in view of this disclosure that the number and location of stirrer passages 24 may vary. In this and in the other vaned impeller of the invention, the number, size and arrangement of the stirrer passages 24 should be selected to provide stirring action while preferably not substantially reducing pumping efficiency and/or substantially adversely affecting the balance of the impeller.

Figure 3:
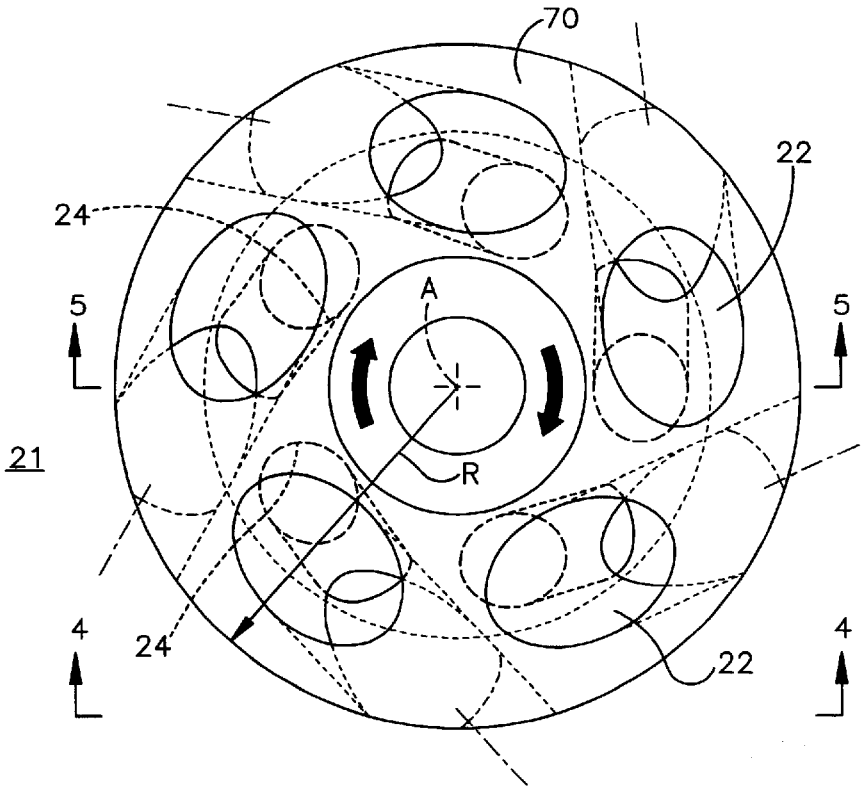
FIG. 3 is a top plan view of the impeller shown in FIG. 2.

The impeller shown in FIGS. 2–5 is rotated in a clockwise direction when viewed from above in a top feed pump. The passages of the impeller extend at a pitch, i.e., not radially from the central hub. In a top feed pump, the passages 22 preferably have a reverse pitch with respect to the direction of rotation (FIG. 3). Forward pitch is defined by a travel path of the passages of FIGS. 1–5 or passages shown in FIG. 6 starting at an end face and moving into the impeller in the same direction as rotation, whereas reverse pitch is defined by a travel path of the passages of FIGS. 1–5 or passages shown in FIG. 6 starting at an end face and moving into the impeller away from or opposite to the direction of rotation. The pitch of the stirrer passages 24 is preferably a mirror image of the upper passages. In other words, as shown in FIGS. 2 and 3, the direction of rotation of the impeller is counterclockwise when viewed from below, and the passages 24 are reversed pitched relative to this rotation. The pitch of the passages 24 is believed to stir up solid matter in the molten metal and cause the solid matter, especially on or near the bottom of the vessel, to move toward the upper surface of the bath where it may be removed by skimming.

It should be appreciated that the impeller 21 could be designed so that the passages 24 are much larger, for example, as large as the passages 22 or even larger. Such passages are then more appropriately referred to as infeed passages as the impeller would draw molten metal from the passages 22 and the passages 24. Also, the impeller 21 may be designed to have an upper annular recess and to include bearing rings disposed in the upper and lower recesses and cemented in place. The base would carry corresponding bearing rings in alignment with the impeller bearing rings (e.g., in the manner of FIG. 18).

When a bottom feed pump is used, an pitch of an inlet located at the bottom of the base may be defined with respect to rotation of the bottom end face. In an impeller for a bottom feed pump, the pitch of the inlet passages of a bottom end face is reverse pitch with respect to the counterclockwise rotation seen by the bottom end face, while the pitch of the passages of the top end face is reverse pitched with respect to the clockwise rotation seen by the top face. The pitch requirements discussed above also apply to the impeller shown in FIG. 6. Those skilled in the art will appreciate in view of this disclosure that the impeller may rotate counterclockwise with the attendant changes to the design of the impeller and its passages.

Figure 10:
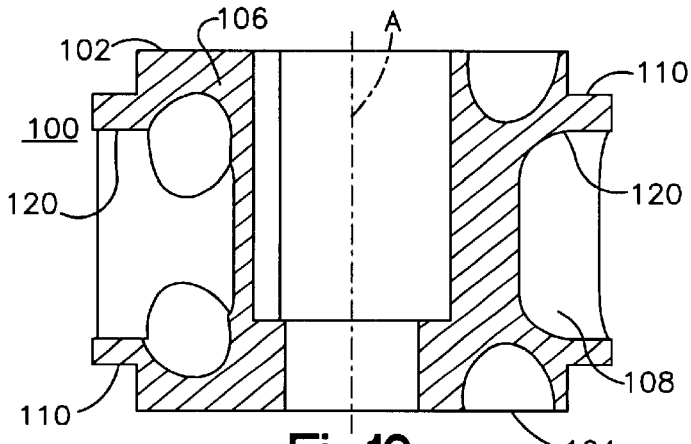
FIG. 10 is a vertical cross-sectional view as seen along the plane designated 10—10 in FIG. 9.
Figure 11:
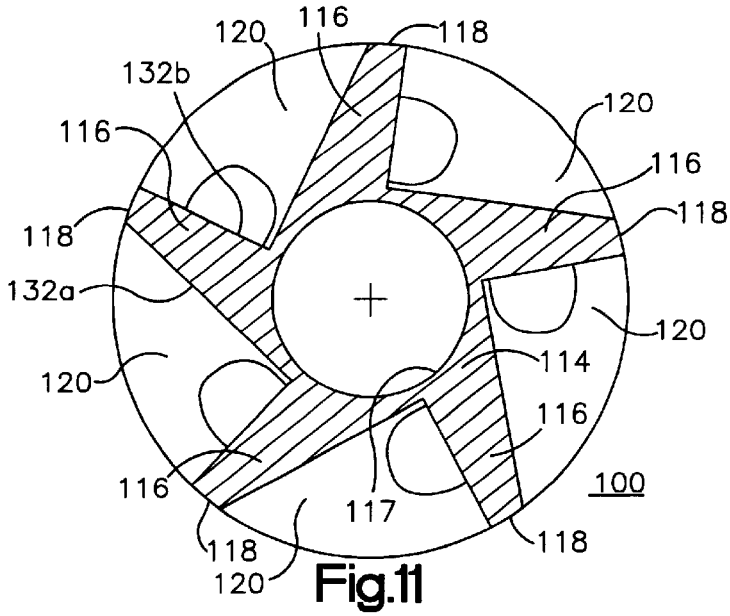
FIG. 11 is a cross-sectional view as seen from the plane designated 11—11 in FIG. 8.
Figure 12:
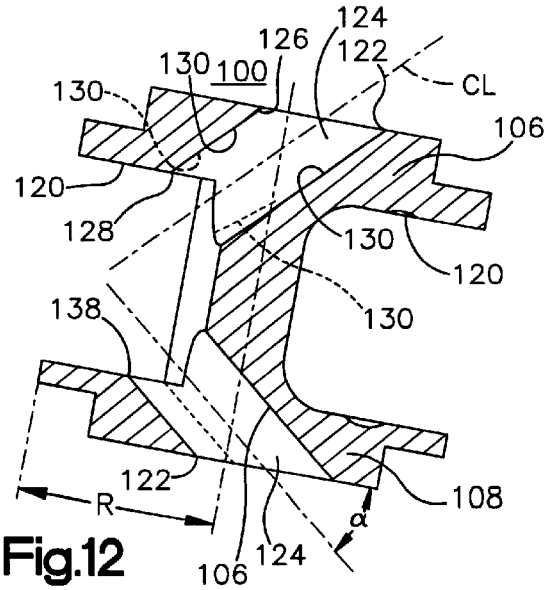
FIG. 12 is a cross-sectional view as seen from the plane designated 12—12 in FIG. 9.

A different impeller 100 is shown in FIGS. 6–12 and is characterized by having vanes and no sidewall as contrasted with the impeller 21. The impeller is made of a non-metallic, heat resistant material, such as graphite and/or ceramic, suitable for operating in molten metal. The impeller includes a central rotational axis A, and first and second 102, 104 generally planar end faces extending transverse to the central axis A (FIG. 10). The first end face 102 is formed by the top surface of an upper base 106 of the impeller while the second end face 104 is formed by the bottom surface of a lower base 108 of the impeller (FIG. 12). As shown, formed in the upper and lower impeller bases are annular recesses 110, each of which receives an annular bearing member 112 attached to the impeller body, which is formed of a bearing material such as a ceramic material and cemented in place.

Figure 6:
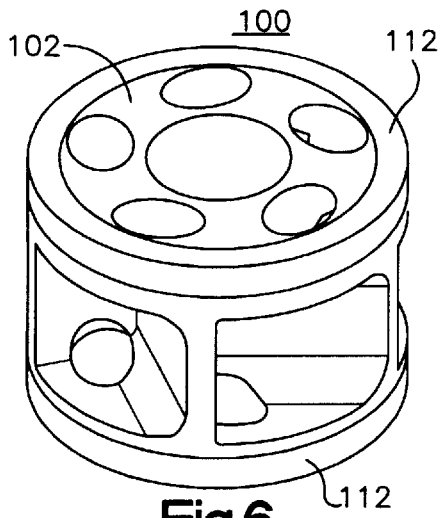
FIGS. 6 and 7 are perspective views of a vaned impeller constructed according to the invention, showing the upper and lower surfaces, respectively.
Figure 7:
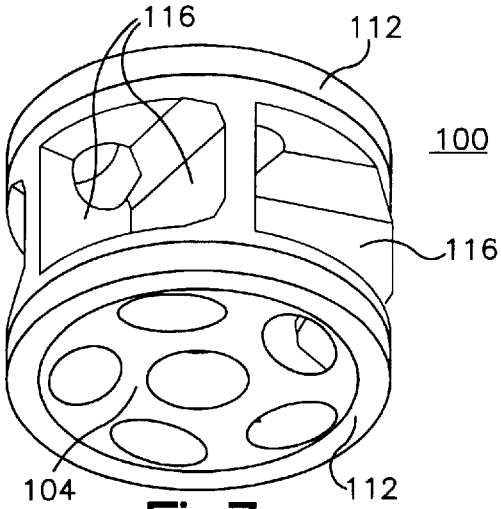
Figure 8:
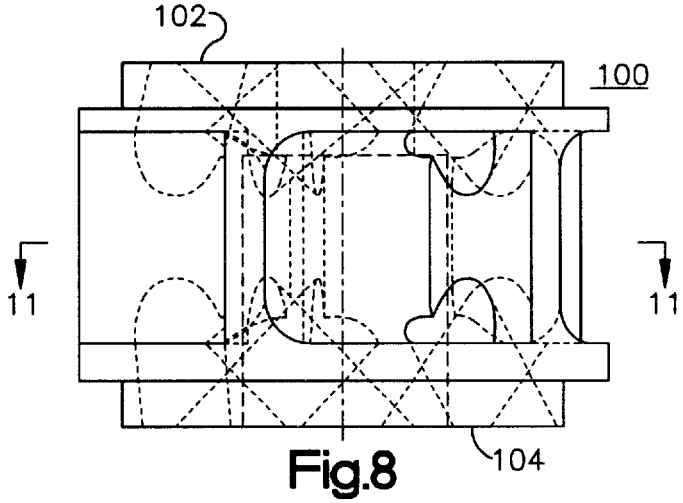
FIG. 8 is a front elevational view of the impeller of FIG. 6.
Figure 9:
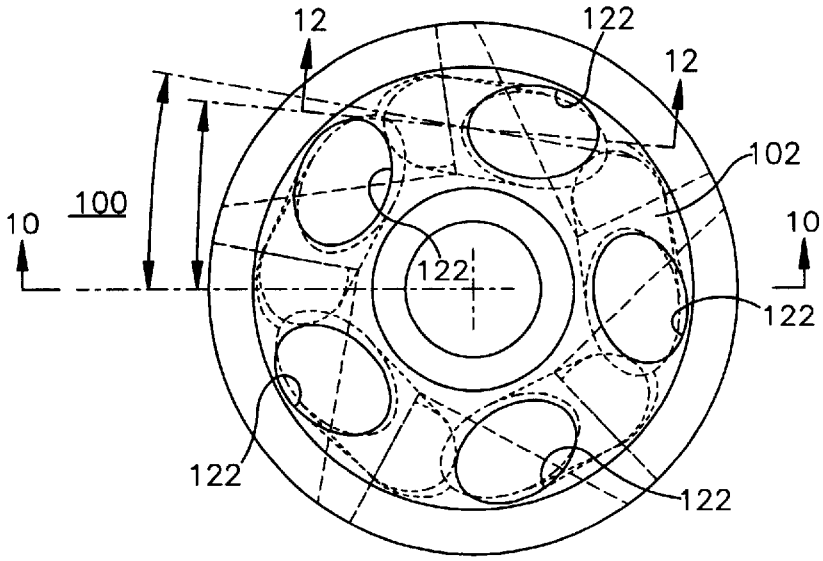
FIG. 9 is a top plan view of the impeller of FIG. 8.

A generally cylindrical central hub portion 114 (FIG. 11) extends between and connects the upper base 106 to the lower base 108 along the rotational axis A. Use of the hub portion is preferred and provides the impeller with desired strength. Preferably five vanes 116 extend outwardly from the hub portion 114, to the outer peripheral surface 118 of the vanes. Using five vanes is believed to overcome vibration problems, as described in U.S. Pat. No. 5,597,289 to Thut, entitled "Dynamically Balanced Pump Impeller," which is incorporated herein by reference in its entirety. However, other numbers of vanes may be suitable for use in the present invention. The vanes also extend from the upper surface of the lower base generally in a direction along axis A to the lower surface of the upper base. Cavities 120 are disposed between each pair of adjacent vanes 116, between the upper and lower impeller bases. A plurality of molten metal inlets 122 are circumferentially spaced apart from one another in the upper and lower end faces. The inlets in the upper and lower end faces form a part of passages 124 which lead to the cavities 120. With respect to the upper passages 124, for example (FIG. 12), the molten metal enters the inlets at an entrance point 126 in the upper base and leaves the upper base at an exit point 128 where it enters a cavity 120. In FIG. 6 five passages are shown. The preferred number of passages is five, but it should be understood to those practicing the art, that other numbers of passages could be used. The molten metal travel path from entrance 126 to exit 128 is inclined all the while and preferably extends throughout the passage 106 along a generally straight line path (along centerline CL, FIG. 12). No portion of the passage extends along the axis A. It should be understood to those practicing the art, that other travel paths may be followed, such as the path of the multi-angled passage 130 shown by dotted lines in FIG. 12. The travel path within the passages is at an angle to the central axis along substantially its entire length and perimeter. The angle of the passages is defined between a radius R (or an end face) and a line parallel to a side wall of the passages 106 as shown by $\alpha$ in FIG. 12, which ranges from about 30 to about 75° and is preferably about 45°, although the angle may vary based upon the height and diameter of the impeller, cross-sectional area of the passages and passage spacing. The angle of the passages is intended to provide the impeller with a high operating efficiency.

As best shown in FIG. 11, the vanes preferably extend substantially tangentially from the hub portion. The vanes preferably are generally straight rather than curved. That is, a straight line can be drawn completely within a body of a vane for its entire length from the central opening 117 to the outer peripheral surface 118 of the vanes. Each vane has two side surfaces 132*a*, 132*b* that extend in a direction from the hub portion to the vane end portion 118 and in a direction along the rotational axis A between the upper and lower bases of the impeller.

The side surface of each vane is spaced apart from a side surface of an adjacent vane, with a cavity disposed therebetween, entirely along directions parallel to and transverse to the axis A between the upper and lower impeller bases. The impeller has no sidewall and no passages extending to a sidewall, in contrast to the U.S. Pat. No. 5,785,494 impeller. The U.S. Pat. No. 5,785,494 impeller employs a volume of solid material greatly exceeding a volume of passageways, whereas the present impeller has a relatively large volume of cavities which may reduce the opportunity for clogging compared to the U.S. Pat. No. 5,785,494 impeller.

The upper and lower bases are preferably integrally formed with the central hub portion and vanes but may be formed by plates that are cemented or suitably fastened to the top and bottom surfaces of the impeller vanes and central hub.

The mounting hole 117 has internal threads and is centered on the axis A of the impeller. The threads engage external threads of the pump shaft in a known manner.

The infeed passages 124 terminate at the cavities 120. The number of infeed passages is preferably five, with one passage being located between adjacent vanes. However, it will be appreciated by those skilled in the art in view of this disclosure that the number and location of the infeed passages in the impeller bases may vary.

The vaned impeller 100 is designed to facilitate simultaneous drawing of molten metal from the top and bottom of the impeller. In this respect the pump in which it is employed may be referred to as a top-and-bottom feed pump. The passages of the impeller are shown having approximately equal cross-sectional area as one another. However, their size may be varied to control the relative volumes of molten metal designed to be drawn into the pump from the top and bottom. Thus, with larger, cross-sectional area upper passages, the pump could operate as primarily top feed with lower stirrer passages if the cross-sectional area of the lower passages is substantially less as shown at 138 by the lower solid line and upper dotted line in FIG. 12 and, with larger bottom passages than top passages, the pump may function as primarily bottom feed with optional upper stirrer passages. The inventive vaned impeller advantageously avoids jamming.

Thus, if a base is designed so as to include two impellers "stacked" on one another as disclosed in the U.S. Pat. No. 4,786,230, molten metal may be directed in different locations by each impeller, which is facilitated by designing the passages to infeed from an intended portion of the base, top or bottom. Also, the relative pumping pressure caused by each impeller may be varied by the size and/or number of the passages.

Figure 14:
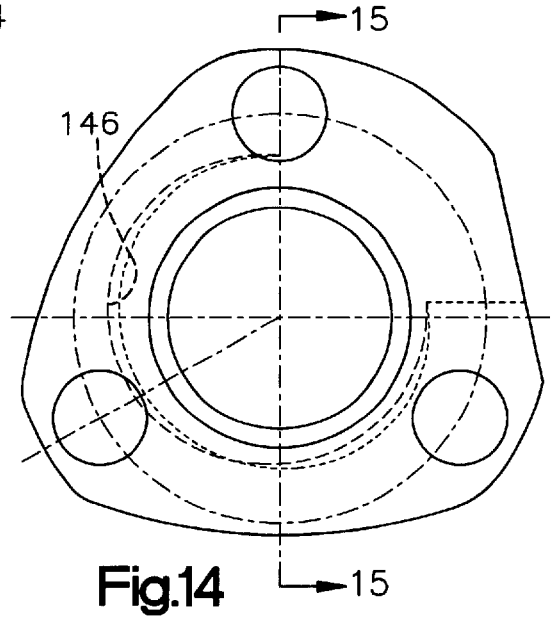
FIG. 14 is a top plan view of the base shown in FIG. 13.
Figure 15:
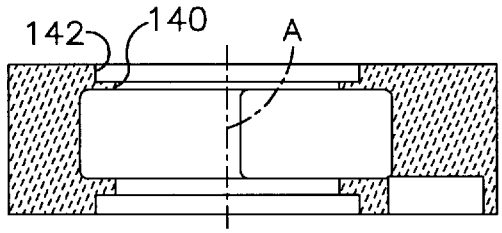
FIG. 15 is a vertical cross-sectional view as seen from the plane designated 15—15 in FIG. 14.
Figure 16:
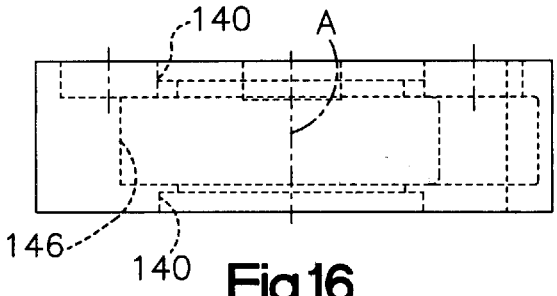
FIG. 16 is a side elevational view of the base shown in FIG. 14.

Moreover, the impeller may be used in a pump base which employs a volute opening as shown in FIG. 14. The infeed passages in the top and bottom faces of the impeller act as strainer passages to prevent clogging. The volute opening may be used in the present invention to provide the increased pumping pressure required for transfer pumping applications, while not leading to clogging problems to which volute type pumps may be subject. In addition, even when used in circulation applications, a volute may be used with the inventive impellers since the instances of clogging are reduced and the pump may benefit from the greater pumping pressure achieved with the use of the volute.

Figure 13:
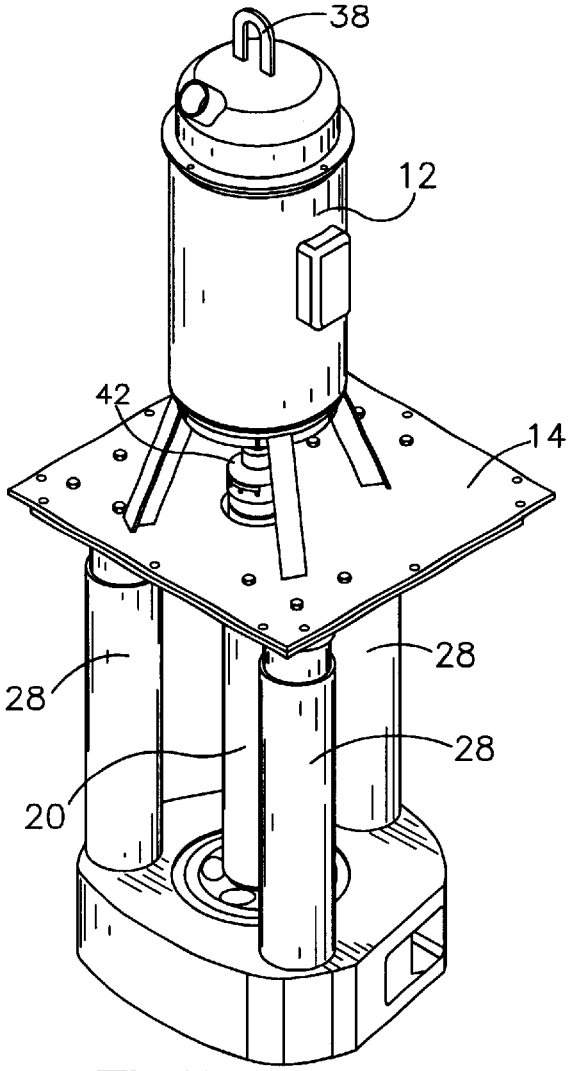
FIG. 13 is a perspective view of a pump constructed according to the present invention which employs the impeller of FIGS. 6–12.

The pump that is shown in FIG. 13 is a top-and-bottom feed circulation pump. Like numerals are used to designate like parts throughout the several views of this application. This pump does not include a shaft sleeve. The base is fabricated using a CNC machine to form the concentric openings 140 in upper and lower surfaces of the base relative to rotational axis A and surrounding recesses 142 in which base bearing rings are cemented in place. The spiral shaped volute opening 146 is also formed in the base with the CNC machine, which avoids attaching parts to the base such as a volute member and lower plate, as was the conventional practice.

Figure 17:
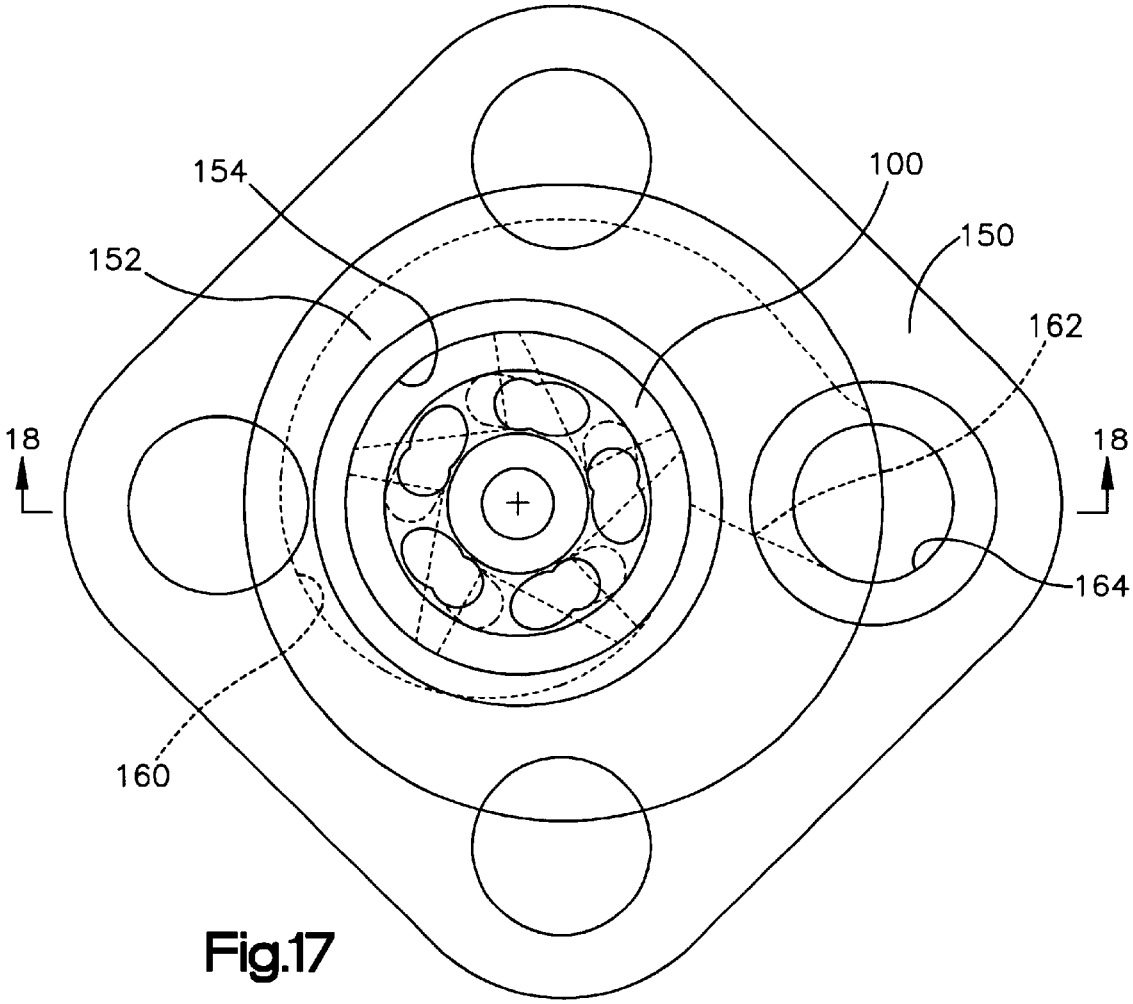
FIG. 17 is a top plan view of a base which employs an impeller of the type shown in FIGS. 6–12.
Figure 18:
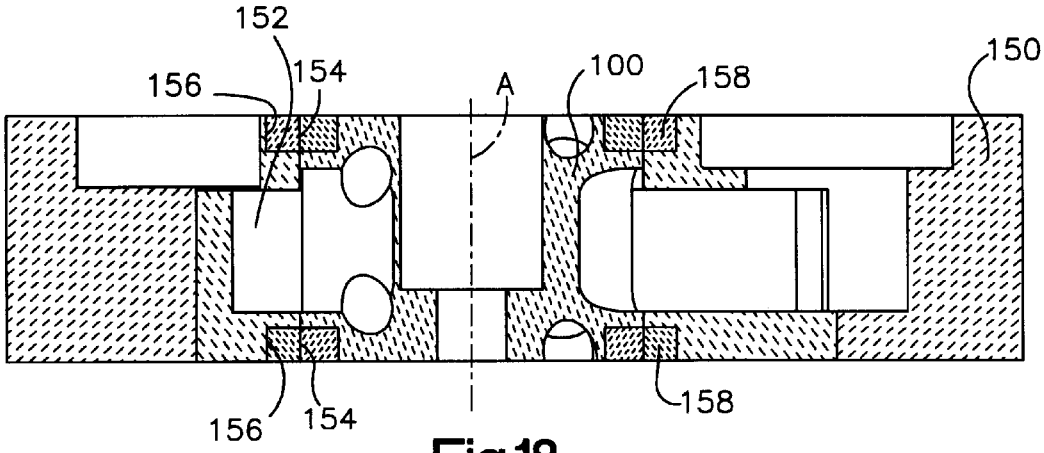
FIG. 18 is a vertical cross-sectional view of a base of FIG. 17.

The vaned impeller 100 is shown positioned in a base 150 of a top-and-bottom feed transfer pump in FIGS. 17 and 18. The base includes an impeller chamber 152 and has concentric upper and lower openings 154 with respect to axis A. Annular recesses 156 surround the openings 154 and receive bearing rings 158. These figures illustrate a preferred use of a spiral shaped volute opening 160 and its spacing and arrangement relative to the impeller. The impeller rotates clockwise in the base shown. Extending tangentially to the impeller chamber or, more specifically, the volute opening, is a discharge passage 162 leading to a riser passage 164.

Many modifications and variations of the invention will be apparent to those of ordinary skill in the art in light of the foregoing disclosure. Therefore, it is to be understood that, within the scope of the appended claims, the invention can be practiced otherwise than has been specifically shown and described.

What is claimed is:

1. In a pump for pumping molten metal including a motor, a shaft having one end connected to the motor, an impeller connected to the other end of the shaft, a base having an impeller chamber in which the impeller is rotatable, concentric openings in upper and lower portions of said base, and an elongated discharge passageway that extends from said impeller chamber, the improvement wherein the impeller is made of a non-metallic, heat resistant material, and comprises a generally cylindrical shaped body having a central rotational axis aligned with said concentric openings, first and second end faces extending transverse to the central axis, a side wall extending between the first and second end faces, a plurality of first inlet openings circumferentially spaced apart from each other on said first end face, a plurality of second inlet openings circumferentially spaced apart from each other on said second end face, connecting passages extending in the body of said impeller and outlet openings located at said side wall, wherein each of said outlet openings is connected to both said first inlet openings and said second inlet openings by said connecting passages.

2. The improvement of claim 1 wherein said connecting passages extend to said impeller sidewall at a downward angle relative to an axis extending radially from the central axis.

3. The improvement of claim 1 comprising a bearing member attached to said body around said first end face.

4. The improvement of claim 1 comprising a bearing member attached to said body around said second end face.

5. The improvement of claim 1 wherein said connecting passages extend at an angle to the central axis along substantially an entire length and perimeter of said connecting passages.

6. The improvement of claim 1 wherein said connecting passages extend from an upper one of said first and second end faces to said outlet openings in a direction away from a direction of rotation of said first end face.

7. The improvement of claim 6 wherein said connecting passages. extend from a lower one of said first and second end faces to said outlet openings in a direction away from a direction of rotation of said second end face.

8. The improvement of claim 1 wherein said impeller chamber comprises a wall that forms a spiral shaped volute opening with said impeller which increases in size in a circumferential direction toward said discharge passageway.

9. The improvement of claim 8 wherein said wall forms the spiral shaped volute opening, uninterrupted, from near one of said concentric openings in the upper portion of said base, to near the other of said concentric openings in the lower portion of said base.

10. The improvement of claim 1 comprising a hanger attached to said pump.

11. The improvement of claim 1 wherein said connecting passages comprise direct connecting portions which directly connect said outlets to one of said first inlet openings and said second inlet openings and indirect connecting portions which extend from one of said first inlet openings and said second inlet openings to said direct connecting portions.

12. In a pump for pumping molten metal including a motor, a shaft having one end connected to the motor, an impeller connected to the other end of the shaft, a base having an impeller chamber in which the impeller is rotatable, concentric openings in upper and lower portions of said base, and an elongated discharge passageway that extends from said impeller chamber, the improvement wherein the impeller is made of a non-metallic, heat resistant material and comprises a central hub portion extending along a central rotational axis of the impeller, first and second impeller bases extending from the hub portion at opposing end portions of the impeller transverse to the central axis, said first impeller base and said second impeller base each comprising an outer end face, vanes extending from said central hub portion between the first and second impeller bases, wherein cavities are formed between said first and second impeller bases and between adjacent said vanes, and a plurality of molten metal passages circumferentially spaced apart from one another in said first end face and said second end face and terminating at said cavities.

13. The improvement of claim 12 wherein said passages are inclined so as to extend through said first base and said second base at an angle to the central axis along substantially an entire length and perimeter of said passages.

14. The improvement of claim 12 wherein said passages extend from an upper one of said first and second end faces to said cavities in a direction away from a direction of rotation of said upper end face.

15. The improvement of claim 14 wherein said passages extend from a lower one of said first and second end faces to said cavities in a direction away from a direction of rotation of said lower end face.

16. The improvement of claim 12 wherein said impeller chamber comprises a wall that forms a spiral shaped volute opening with said impeller which increases in size in a circumferential direction toward said discharge passageway.

17. The improvement of claim 12 comprising a hanger attached to said pump.

18. An impeller made of a non-metallic, heat resistant material, comprising a generally cylindrical shaped body having a central rotational axis, first and second end faces extending transverse to the central axis, a side wall extending between the first and second end faces, a plurality of first inlet openings circumferentially spaced apart from each other on said first end face, a plurality of second inlet openings circumferentially spaced apart from each other on said second end face, connecting passages extending in the body of said impeller and outlet openings located at said side wall, wherein each of said outlet openings is connected to both said first inlet openings and said second inlet openings by said connecting passages.

19. The impeller of claim 18 wherein said connecting passages extend to said impeller sidewall at a downward angle relative to an axis extending radially from the central axis.

20. The impeller of claim 18 comprising a bearing member attached to said body around said first end face.

21. The impeller of claim 18 comprising a bearing member attached to said body around said second end face.

22. The impeller of claim 18 wherein said connecting passages extend at an angle to the central axis along substantially an entire length and perimeter of said connecting passages.

23. The impeller of claim 18 wherein said connecting passages extend from an upper one of said first and second end faces to said outlet openings in. a direction away from a direction of rotation of said first end face.

24. The impeller of claim 23 wherein said connecting passages extend from a lower one of said first and second end faces to said outlet openings in a direction away from a direction of rotation of said second end face.

25. The impeller of claim 18 wherein said connecting passages comprise direct connecting portions which directly connect said outlets to one of said first inlet openings and said second inlet openings and indirect connecting portions which extend from one of said first inlet openings and said second inlet openings to said direct connecting portions.

26. An impeller made of a non-metallic, heat resistant material comprising a central hub portion extending along a rotational axis of the impeller, first and second impeller bases extending from the hub portion at opposing end portions of the impeller transverse to the central axis, said first impeller base and said second impeller base each comprising an outer end face, vanes extending from said central hub portion between the first and second impeller bases, wherein cavities are formed between said first and second impeller bases and between adjacent said vanes, and a plurality of molten metal passages circumferentially spaced apart from one another in said first end face and said second end face terminating at said cavities.

27. The impeller of claim 26 wherein said passages are inclined so as to extend through said first base and said second base at an angle to the central axis along substantially an entire length and perimeter of said passages.

28. The impeller of claim 27 wherein said passages extend from an upper one of said first and second end faces to said cavities in a direction away from a direction of rotation of said upper end face.

29. The impeller of claim 28 wherein said passages extend from a lower one of said first and second end faces to said cavities in a direction away from a direction of rotation of said lower end face.

30. A pump for pumping molten metal comprising:

a motor;

a shaft having one end connected to the motor;

an impeller connected to the other end of the shaft;

a base having an impeller chamber in which the impeller is rotatable;

an upper opening in an upper portion of said base and a lower opening in a lower portion of said base;

a discharge passageway that extends from said impeller chamber;

said impeller chamber comprising a wall that forms a spiral shaped volute opening which increases in size in a circumferential direction toward said discharge passageway, wherein said wall forms the spiral shaped volute opening, uninterrupted, from near said upper opening to near said lower opening; and wherein the impeller is made of a non-metallic, heat resistant material, and comprises:

a generally cylindrical shaped body having a central rotational axis, first and second end faces extending transverse to the central axis, a side wall extending between the first and second end faces, a plurality of first inlet openings located on said first end face, a plurality of second inlet openings located on said second end face, connecting passages extending in the body of said impeller, and outlet openings located at said side wall which are connected to said first inlet openings and said second inlet openings by said connecting passages.

31. A pump for pumping molten metal comprising:

a motor;

a shaft having one end connected to the motor;

an impeller connected to the other end of the shaft;

a base having an impeller chamber in which the impeller is rotatable;

an upper opening in an upper portion of said base and a lower opening in a lower portion of said base;

a discharge passageway that extends from said impeller chamber;

said impeller chamber comprising a wall that forms a spiral shaped volute opening which increases in size in a circumferential direction toward said discharge passageway, wherein said wall forms the spiral shaped volute opening, uninterrupted, from near said upper opening to near said lower opening; and wherein the impeller is made of a non-metallic, heat resistant material, and comprises:

a central hub portion extending along a rotational axis of the impeller, first and second impeller bases extending from the hub portion at opposing end portions of the impeller transverse to the rotational axis, vanes extending from said central hub portion between the first and second impeller bases, cavities formed between said first and second impeller bases and between adjacent said vanes, and a plurality of molten metal passages extending in said first impeller base and said second impeller base to said cavities.

* * * * *